US006375043B1

(12) United States Patent
LeBlanc

(10) Patent No.: US 6,375,043 B1
(45) Date of Patent: Apr. 23, 2002

(54) DRINK MACHINE

(76) Inventor: Patrick T. LeBlanc, 10046 Hawthorne Dr., Baton Rouge, LA (US) 70809

( * ) Notice: Subject to any disclaimer, the term of this patent is extended or adjusted under 35 U.S.C. 154(b) by 0 days.

(21) Appl. No.: 09/714,403

(22) Filed: Nov. 16, 2000

Related U.S. Application Data

(60) Provisional application No. 60/233,923, filed on Sep. 20, 2000.

(51) Int. Cl.[7] ..... B67D 5/56

(52) U.S. Cl. ..... 222/129.4; 222/132; 222/15.5; 222/504

(58) Field of Search ..... 222/129.1, 129.3, 222/129.4, 132, 145.5, 504

(56) References Cited

U.S. PATENT DOCUMENTS

| | | | | |
|---|---|---|---|---|
| 1,979,323 A | | 11/1934 | Felesina et al. | 225/21 |
| 3,097,670 A | | 7/1963 | Berman | 141/83 |
| 3,193,143 A | * | 7/1965 | Maieli | 222/129.4 X |
| 3,341,078 A | | 9/1967 | Carddillo | 222/129.4 |
| 3,675,820 A | | 7/1972 | Newberry et al. | 222/129.4 |
| 3,884,391 A | * | 5/1975 | Pauliukonis | 222/129.4 |
| 3,920,149 A | | 11/1975 | Fortino | 222/129.3 |
| 3,940,019 A | | 2/1976 | Kross et al. | 222/129.4 |
| 3,991,911 A | | 11/1976 | Shannon et al. | 222/25 |
| 4,282,987 A | | 8/1981 | Thomas et al. | 222/70 |
| 4,360,128 A | | 11/1982 | Neumann | 222/26 |
| 4,493,441 A | | 1/1985 | Sedam et al. | 222/129.1 |
| 4,628,974 A | * | 12/1986 | Meyer | 222/129.4 X |
| 4,827,426 A | * | 5/1989 | Patton et al. | 222/129.4 X |
| 4,932,561 A | | 6/1990 | Boxall | 222/54 |
| 4,938,387 A | * | 7/1990 | Kervefors et al. | 222/129.4 |

FOREIGN PATENT DOCUMENTS

| | | |
|---|---|---|
| EP | 0 947 518 A1 | 6/1999 |

* cited by examiner

*Primary Examiner*—Kenneth Bomberg
(74) *Attorney, Agent, or Firm*—David L. Ray

(57) ABSTRACT

An automatic mixed drink dispensing apparatus wherein individual ingredients are combined according to pre-programmed recipes to produce a complete mixed drink. A single chip digital computer provides the control means to interact with the user, store recipes and calculate dispensation times. The computer calculates dispensation times based upon the relationship between gravity flow and liquid level in the ingredient containers. The control system is physically isolated from the dispensation means and operates by electromagnetic repulsion.

20 Claims, 9 Drawing Sheets

SAMPLE MENU

| | | |
|---|---|---|
| 1 | WOBBLY WILDCAT | vod + blue curaçao + blue fruit punch |
| 2 | TANKED TIGER | gin + rum + vodka + grape juice |
| 3 | BLUE AGAVE | teq + blue curaçao + 7UP |

| | | |
|---|---|---|
| 4 | CUBA LIBRE | rum + coke |
| 5 | PURPLE PIRATE | rum + grape juice |
| 6 | CARRI-B-unCOLA | rum + 7UP |
| 7 | BLOCKED PUNTch | rum + blue fruit punch |
| 8 | JAMAICAN JUICER | rum + orange juice |

| | | |
|---|---|---|
| 9 | MARGARITA | tequila + margarita mix |
| 10 | CHIHUAHUA PISS | tequila + lemonade |
| 11 | MEXICAN MERLOT | tequila + grape juice |
| 12 | ALAMO SPLASH | tequila + orange juice + 7UP |
| 13 | T. N. T. | tequila + tonic |
| 14 | KRUSHED KITTEN | tequila + blue fruit punch |

| | | |
|---|---|---|
| 15 | gINSTANT REPLAY | gin + tonic + gin + tonic |
| 16 | PICADILLY PORT | gin + grape juice |
| 17 | GINERATOR | gin + orange juice |
| 18 | gINTERFERENCE | gin + blue fruit punch |
| 19 | bLIMEY | gin + 7UP |

| | | |
|---|---|---|
| 20 | SCREWDRIVER | vodka + orange juice |
| 21 | PETER THE GRAPE | vodka + grape juice |
| 22 | LENINADE | vodka + lemonade |
| 23 | BLUE BLOCKER | vodka + blue fruit punch |
| 24 | RUSHIN' RECEIVER | vodka + tonic |

| | | |
|---|---|---|
| 25 | .38 SPECIAL | bourbon + coke |
| 26 | LEXINGTON LEMONADE | bourbon + lemonade |
| 27 | BUBBLIN' CRUDE | bourbon + 7UP |
| 28 | KENTUCKY BLUE GRASS | bourbon + blue curaçao + fruit punch |

*FIG. 8*

DRINK MACHINE

CROSS-REFERENCE TO RELATED APPLICATIONS

This application claims the benefit of the filing date and priority of provisional application serial No. 60/233,923 filed Sep. 20, 2000.

BACKGROUND OF THE INVENTION

1. Field of the Invention

The invention relates to a system for automatically dispensing beverages. More particularly, the invention relates to a system for automatically dispensing the ingredients of alcoholic mixed drinks according to pre-programmed recipes with minimal user input.

2. Description of the Related Art

The problems associated with manual preparation of alcoholic mixed drinks are well documented. These problems include, but are not limited to, accuracy, consistency and speed. A more thorough description of these and other issues related to manual drink preparation and proposed solutions appear in U.S. Pat. Nos. 3,940,019 and 3,991,911.

The above cited prior art patents also address problems peculiar to the large volumes involved in their use in a commercial environment. Those problems include re-supply, spillage, pilferage and accounting. To facilitate re-supply and minimize spillage, the prior art utilized ingredients in their original containers. The prior art also dealt with pilferage and accounting by including elaborate electro-mechanical means to track the use of ingredients. Prior art also included means to calculate and display the price to charge for a particular drink based upon its ingredients.

In the prior art, the means by which liquids are dispensed from their containers vary widely. In U.S. Pat. No. 3,940,019, a piston pump delivers a fixed amount of liquid with each stroke. The amount dispensed depends on the number of strokes directed by the control means. In U.S. Pat. No. 3,991,911, the arrangement of the apparatus ensures that the level in the reservoir remains constant. Upon actuation by the control means, compressed air forces liquid out of the reservoir.

While these means are quite different mechanically, their underlying operation is identical. Each dispenses liquid from its original container at a fixed flow rate. Once the means to dispense liquid at a fixed flow rate is established, the amount of liquid dispensed depends only on the time that the dispenser is activated. Furthermore, the time required to dispense a given amount of liquid (for example, an ounce) is always the same. Given a fixed rate of dispensation, the prior art dispensed different amounts of liquid (as required by different mixed drink recipes) by activating the dispensation means for different amounts of time.

In a fixed flow rate system, the accuracy and consistency of the amount of liquid dispensed depends solely on the apparatus' timing capabilities. Prior art achieved extremely high timing reliability through the use of discrete electronic circuitry available at the time of invention.

While discrete electronic components provide repeatable performance, their operational flexibility is limited by the fact that they are interconnected by a fixed network of wiring. In the prior art, each mixed drink recipe consisted of a network of electronic components to actuate the dispensation means of each ingredient and associated timing circuits to control the duration and hence the amount of each ingredient dispensed.

In the prior art, a fixed number of mixed drinks was selectable by the user through an array of pushbuttons. Each pushbutton corresponded to a particular mixed drink and was wired to that particular mixed drink's network of electronic components. Some examples of the prior art allowed for changing the performance of the recipe networks by mechanically adjusting resistors or capacitors or the movement of jumper wires. In essence, the apparatus described is an analog computer which was "state of the art" at the time of invention.

Additional related art are U.S. Pat. Nos. 1,979,323; 3,097,670; 3,341,078; 3,675,820; 3,920,149; 4,282,987; 4,360,128; 4,493,441; 4,932,461; and European Patent Application EP 0 947 518 A1.

To assist in understanding the unique nature of the present invention described below, the basic characteristics of liquid flow out of a container and their impact on prior art will be reviewed. As stated previously, the high volumes of use in a commercial application necessitated dispensing liquids from their original containers. Liquor bottles (and other original containers) are not designed to dispense their contents in a uniform manner. Liquid flow rate is variable and depends on the amount of liquid remaining in the container. As described previously, prior art utilizes ingenious, yet complex, mechanical means to ensure that the flow rate is fixed and independent of the amount of contents remaining.

Considering a simple example of a container with some level of liquid and a hole in its bottom, barring any outside forces other than gravity, fluid mechanics predicts that the flow rate out of the hole at the bottom of the container is inversely proportional to the square root of the level in the container. As liquid is dispensed and the level in the container diminishes, the flow rate diminishes as well.

In a gravity flow system, the time required to dispense a given amount of liquid (for example, an ounce) is not constant but depends on the level in the container. In actuality, the time required to dispense the same amount increases as the level in the container decreases. If the control means actuates the dispensation means for a fixed period each time, less fluid will be delivered each time as the liquid level in the container diminishes. This is obviously undesirable from the standpoints of both accuracy and consistency.

Therefore a control system that depends on fixed flow rates and fixed dispensation times (as in prior art) is not compatible with a gravity flow system. The control means described in U.S. Pat. Nos 3,940,019 and 3,991,911 is linear in nature and worked well with fixed flow rates. It may be inferred that due to its non-linear nature, gravity flow was avoided because the control means available was not compatible. The limited control means was compensated for by mechanical dispensation means as previously described. Advances in Large Scale Integrated Circuits have progressed such that controlling external hardware and performing complex mathematical computations can be accomplished by a single chip computer.

SUMMARY OF THE INVENTION

It is an object of the present invention to provide a drink mixing and dispensing apparatus that does not depend on fixed flow rates.

In accordance with the present invention there is provided an automatic mixed drink dispensing apparatus wherein individual ingredients are combined according to pre-programmed recipes to produce a complete mixed drink. A digital computer provides the control means to interact with the user, store recipes and calculate dispensation times. The computer calculates dispensation times based upon the relationship between gravity flow and liquid level in the ingredient containers. The control system is physically isolated from the dispensation means and operates by electromagnetic repulsion.

BRIEF DESCRIPTION OF THE DRAWINGS

FIG. 8 is a sample menu illustrating mixed drinks, typically available using popular ingredients.

DETAILED DESCRIPTION OF THE INVENTION

Figure 1:
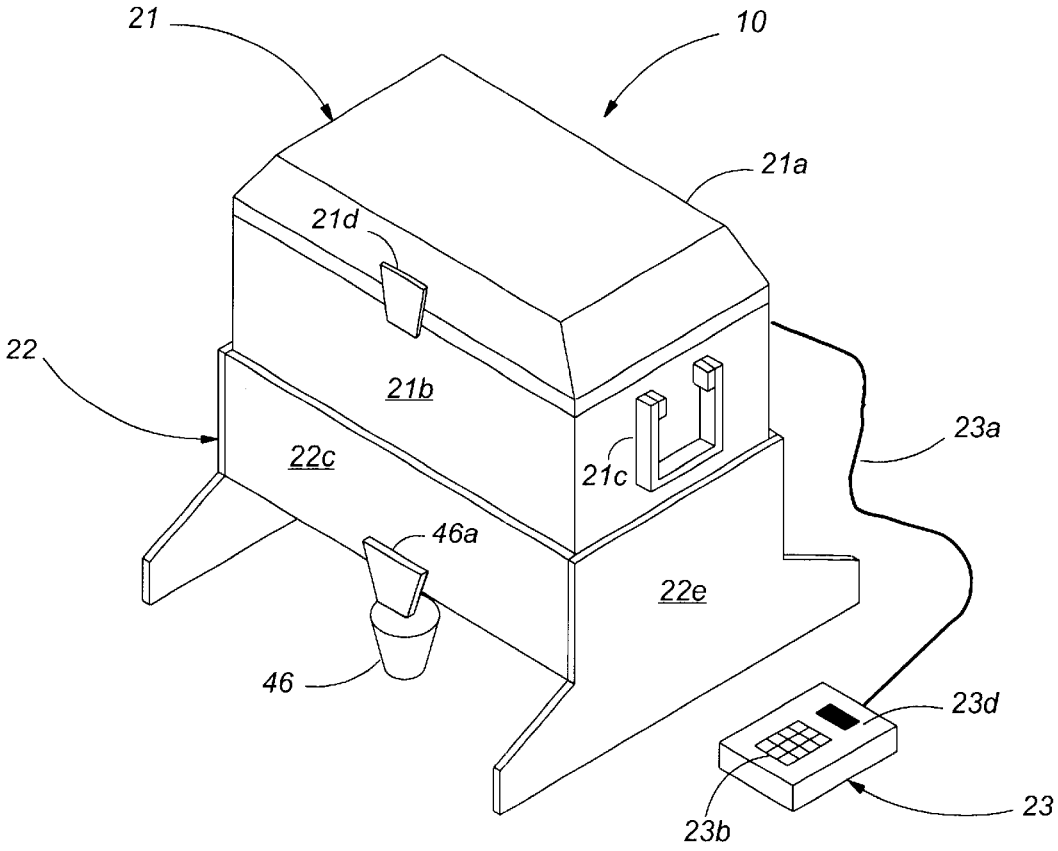
FIG. 1 is a perspective view illustrating the assembled principal components of the mixed drink dispensing apparatus.
Figure 2:
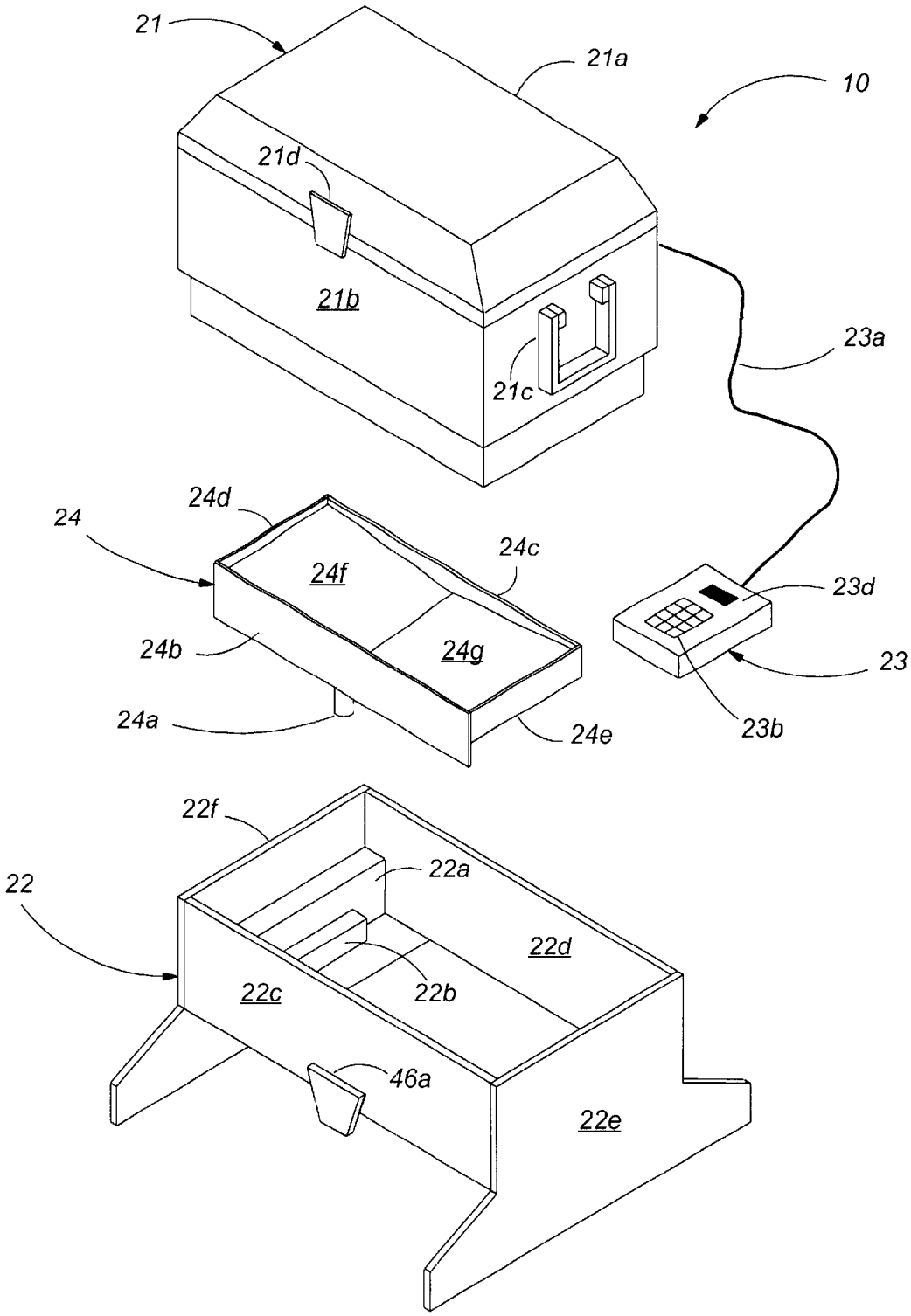
FIG. 2 is a perspective, exploded view illustrating the catch pan that rests in the support stand under a chest.

Referring now to the drawings, the mixed drink dispensing apparatus of the invention is generally referred to by the numeral 10 in FIGS. 1 and 2. Mixed drink dispensing apparatus 10 includes a chest which is preferably an insulated chest commonly known as an ice chest and is generally indicated by the numeral 21. Chest 21 sits within a support stand generally indicated by the numeral 22. The support stand 22 contains a catch pan generally indicated by the numeral 24 supported directly beneath the chest 21 to receive the flow of liquid ingredients and direct them to the user's cup 46 which is placed beneath a cup locator tab 46*a* rigidly connected to support stand 22. Mixed drink dispensing apparatus 10 is controlled through a user interface device generally indicated by the numeral 23.

Figure 4A:
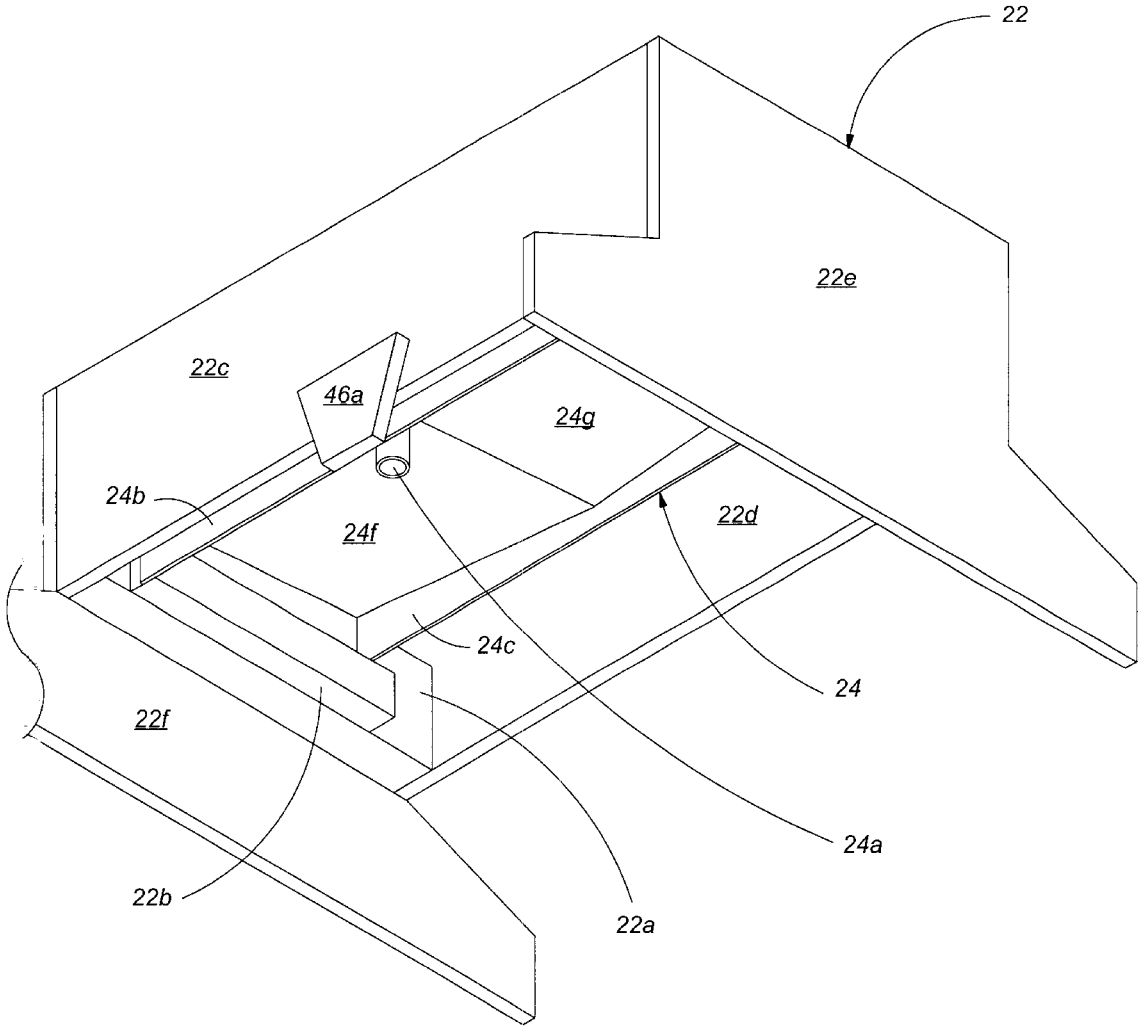
FIG. 4*a* is bottom perspective view of the catch pan and support members.
Figure 4B:
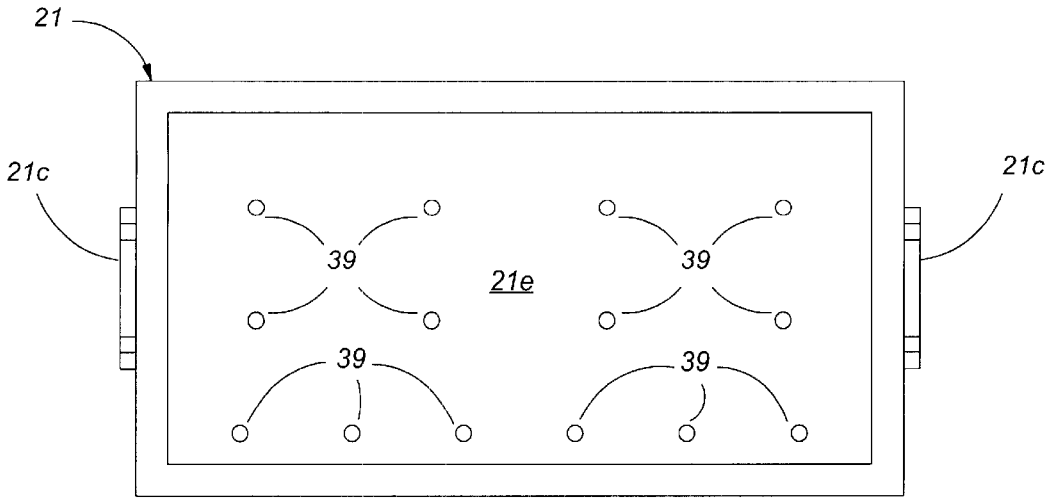
FIG. 4*b* is a top plan view of the chest body of the invention with the top removed illustrating the arrangement of a plurality of holes in the bottom of the chest through which the contents of the ingredient containers flow onto the catch pan.
Figure 4C:
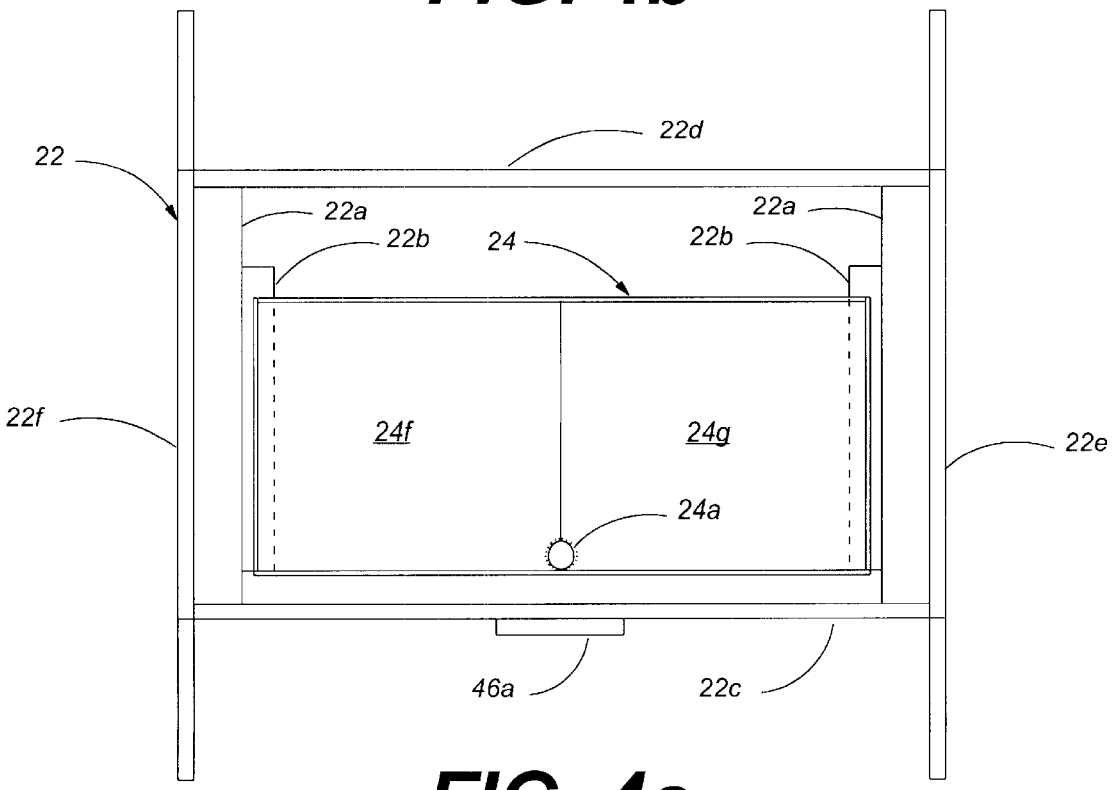
FIG. 4*c* is a top view of the catch pan and support members as shown in FIG. 4*a;*

As shown in FIGS. 2, 4*a* and 4*c*, catch pan 24 sits in support stand 22 under chest 21. Support stand 22 has two bracing members 22*a* to which are rigidly attached two catch pan support members 22*b*. The bottom 21*e* of chest 21 rests upon the top of bracing members 22*a* when chest 21 is resting in support stand 22 as shown in FIG. 1. The bottom of catch pan 24 rests upon the top of catch pan support members 22*b*. If desired, bracing members 22*a* and 22*b* could be integrally constructed from a single rigid material. Bracing member 22*a* is rigidly connected to two generally rectangular parallel vertical side walls 22*c* and 22*d*. Side walls 22*c* and 22*d* are connected perpendicularly at their ends to generally rectangular parallel vertical end walls 22*e* and 22*f*.

In the present embodiment, catch pan 24 is constructed of rigid sheets of opaque or translucent plastic or the like. Catch pan 24 has two parallel vertical generally rectangular side walls 24*b* and 24*c* rigidly connected perpendicularly at the ends thereof to two parallel vertical generally rectangular end walls 24*d* and 24*e*. The bottom of catch pan 24 is formed from generally rectangular rigid bottom sheets 24*f* and 24*g*. Bottom sheet 24*f* is rigidly connected to end wall 24*d* and side walls 24*b* and 24*c*, and bottom sheet 24*g* is rigidly connected to end wall 24*e* and side walls 24*b* and 24*c*. The sheets 24*f* and 24*g* are sloped toward the center of catch pan 24 such that any liquid ingredients that fall on to bottom sheets 24*f* and 24*g* of catch pan 24 are directed to the outlet pipe 24*a*.

Figure 3:
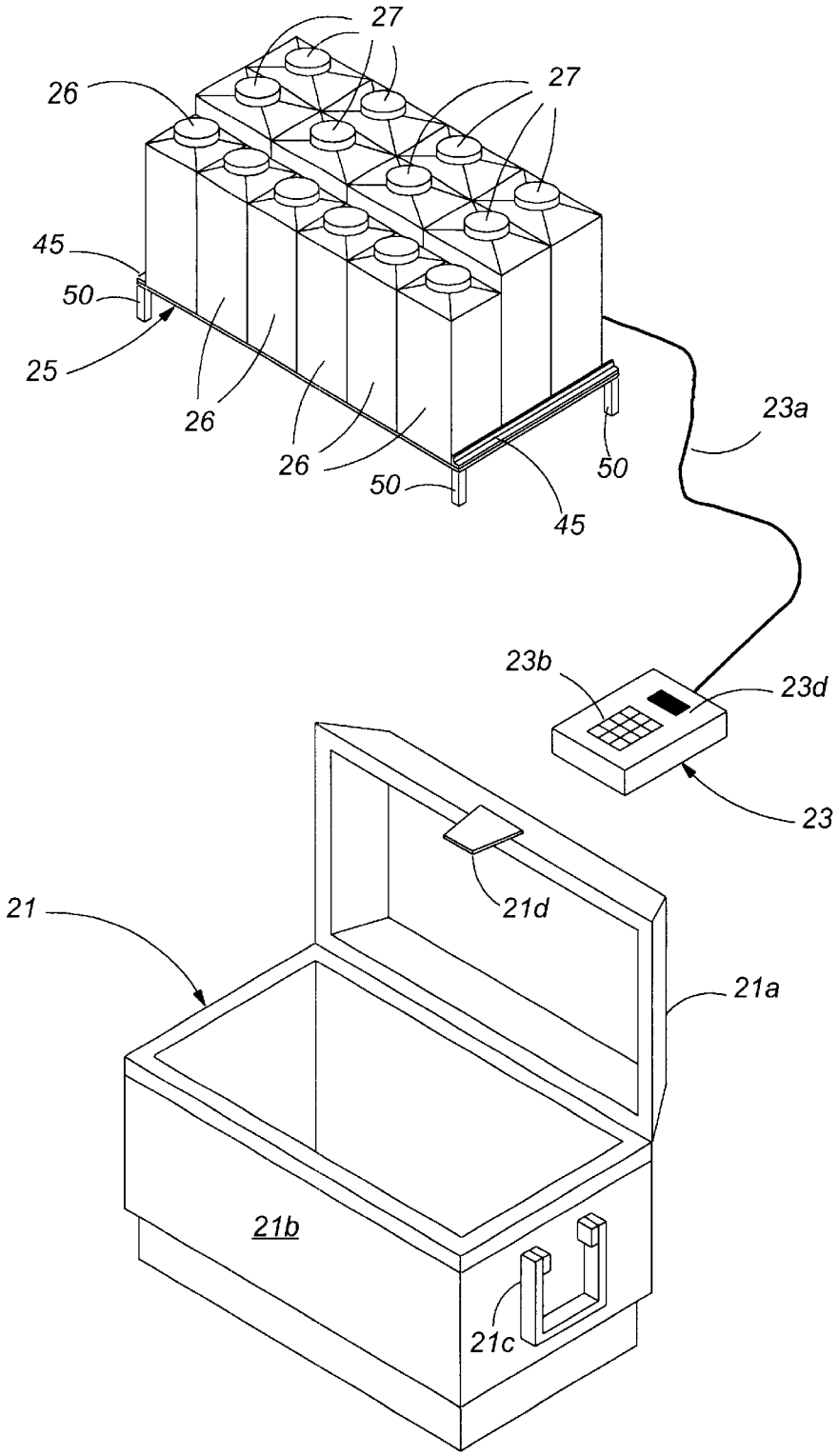
FIG. 3 is a perspective, exploded view illustrating the arrangement of a plurality of ingredient containers inside the chest.

As shown in FIG. 3, chest 21 preferably has a conventional ice chest lid 21*a* which is hinged to chest body 21*b*. Preferably, chest 21 has conventional handles 21*c* at each end thereof for lifting and transporting the chest and a latch 21*d* on lid 21*a* for selectively securing lid 21*a* to chest body 21*b*. Chest 21 is preferably a fifty-four quart ice chest having a plurality of generally cylindrical outlet holes 39 in the bottom 21*e* thereof as shown in FIG. 4*b*.

Figure 5:
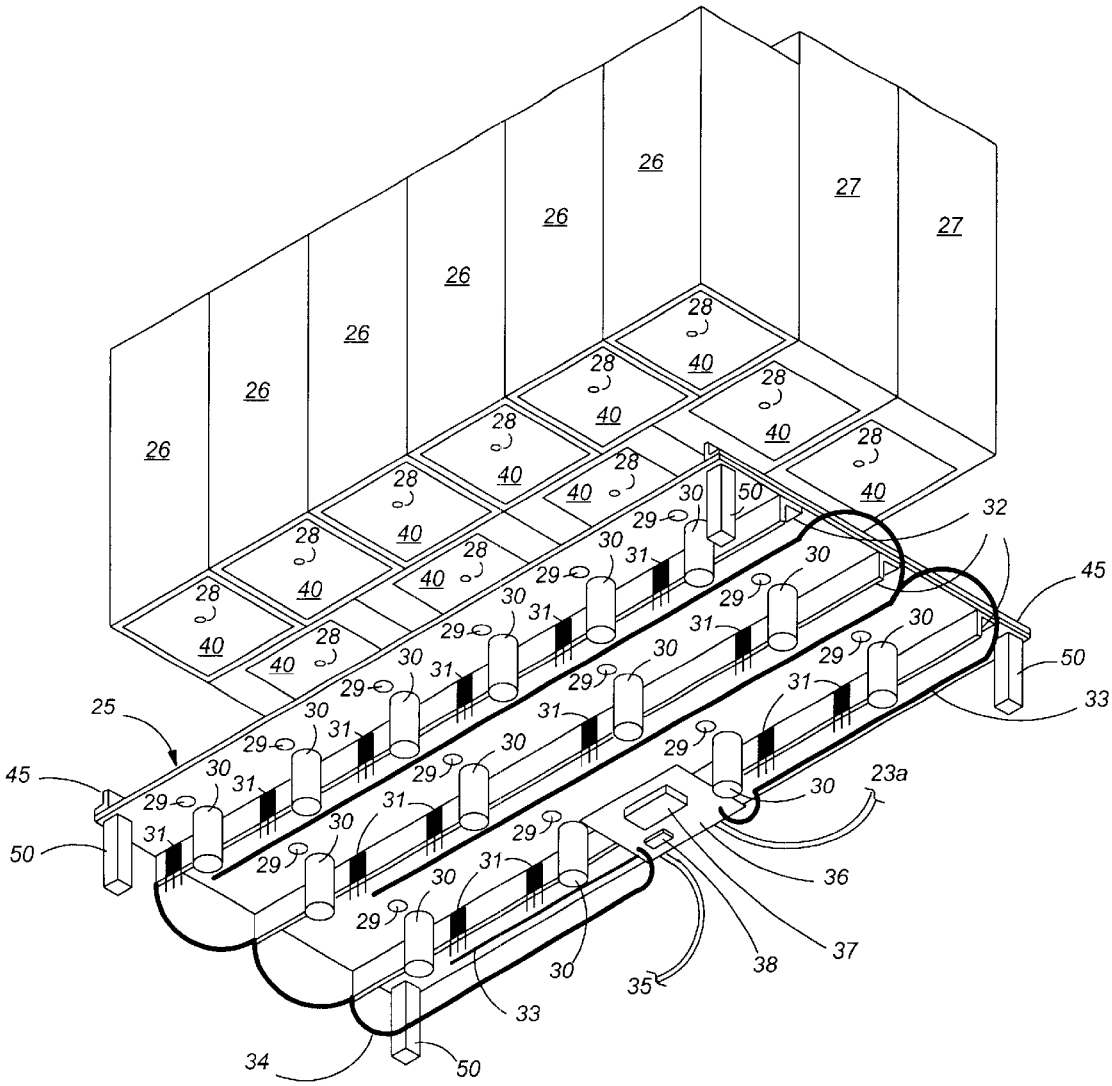
FIG. 5 is a exploded, partly schematic perspective view illustrating the underside of the ingredient containers, ingredient container support tray, and the control elements there beneath.
Figure 6A:
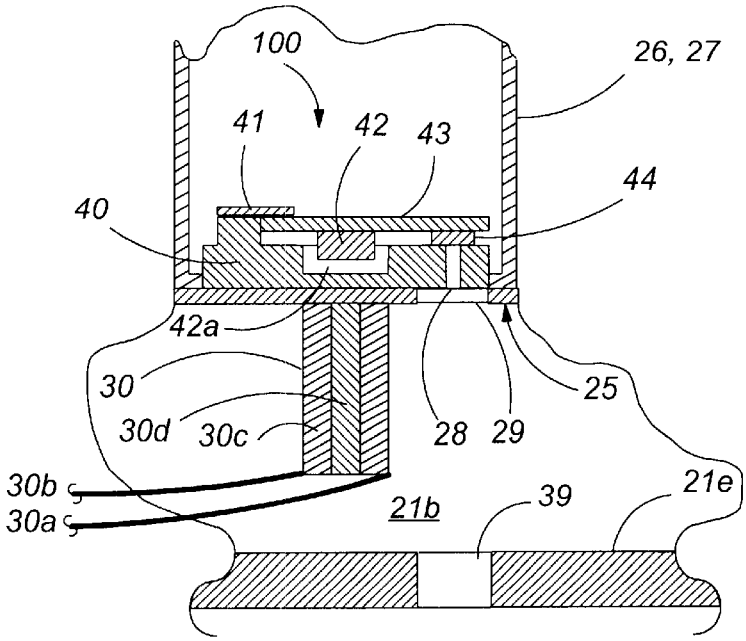
FIG. 6*a* is a schematic sectional view of the interior of a single ingredient container, valve assembly, solenoid, and ingredient container support tray positioned above the bottom of the chest illustrating a valve in the closed position.
Figure 6B:
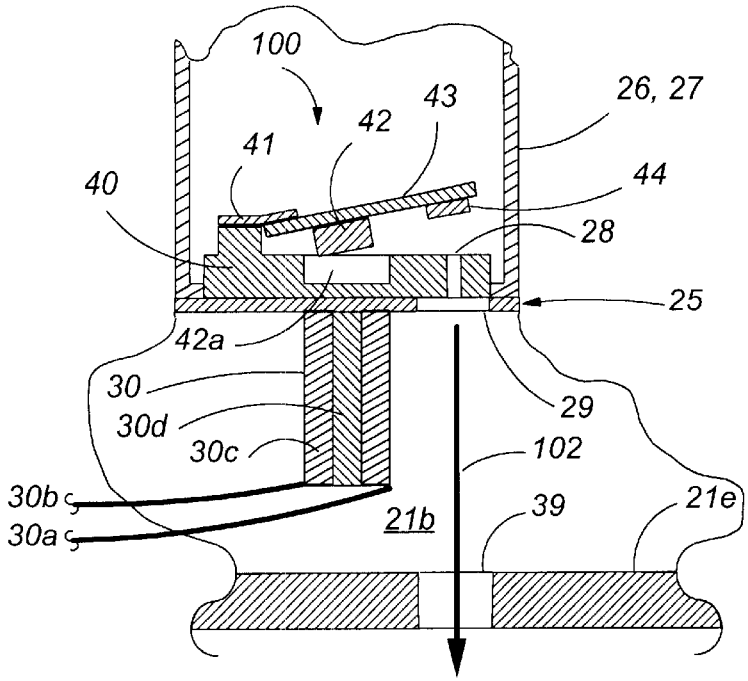
FIG. 6*b* is a schematic sectional view of the interior of a single ingredient container, valve, solenoid, and ingredient container support tray positioned above the bottom of the chest illustrating a valve in the open position.

As shown in FIGS. 3, 5, and sectionally in 6*a* and 6*b*, an ingredient container support tray generally indicated by the numeral 25 supports a plurality of ingredient containers 26 and 27. Ingredient container support tray 25 and ingredient containers 26 and 27 are all housed inside chest 21 as shown in FIGS. 6*a* and 6*b*. Ingredient container support tray 25 has a plurality of legs 50 shown in FIGS. 3 and 5 connected to the bottom thereof which are longer than solenoids 30 connected to the bottom of tray 30 and rest upon the bottom 21*e* of chest 21 to support ingredient container support tray 25 above the bottom 21*e* of chest 21 to provide a space between bottom 21*e* and solenoids 30 as shown in FIG. 6*a* and 6*b*.

The ingredient container support tray 25 is designed such that its exterior dimensions are slightly less than the interior dimensions of the chest 21. When placed in chest 21 as shown in FIGS. 6*a* and 6*b*, hollow generally cylindrical outlet holes 28 in the ingredient containers 26, 27 are aligned with hollow generally cylindrical outlet holes 29 in the ingredient container support tray 25 and outlet holes 39 in the bottom 21*e* of chest 21 as shown in FIGS. 6*a* and 6*b*.

The underside of the ingredient container support tray 25 is shown in FIG. 5. In the present embodiment, angle members 32 are affixed to the underside of the support tray 25 to provide rigidity. Preferably, angle members 32 are made from an electrically conductive metal such as aluminum. The angle members 32 have solenoids 30 connected thereto and angle members 32 serve to align solenoids 30 under the ingredient containers 26 and 27. The angle members 32 also have affixed thereto a plurality of transistors 31 located adjacent to their associated solenoids 30, and angle members 32 serve as a portion of the ground bus 34. Additional angle members generally indicated by the numeral 45 are affixed to the top of the ingredient container support tray 25 to provide cross-bracing and to align the ingredient containers 26 and 27.

User interface device 23 is in electrical communication through cable 23*a* with the plurality of solenoids 30. As shown in FIGS. 6*a* and 6*b*, each of the solenoids 30 are connected to ingredient container support tray 25 adjacent to the base of ingredient containers 26,27. Each of the solenoids 30 have electrical leads 30*a* and 30*b* connected to hollow cylindrical coil 30*c* to provide electrical energy to coil 30*c*, and cylindrical plunger 30*d* inside of hollow coil 30*c* is rigidly connected to the inside of coil 30*c* and held stationary therein by any conventional method such as gluing welding or the like. Solenoids 30 actuate a valve mechanism generally indicated by the numeral 100 in FIGS. 6*a* and 6*b* to selectively dispense liquid beverages from ingredient containers 26, 27 as commanded by user interface device 23. Preferably, ingredient containers 26 have a volume of thirty-two ounces and ingredient containers 27 have a volume of sixty-four ounces.

As shown in FIG. 5, the bottom of each of the ingredient containers 26, 27 has a generally rectangular base 40 provided with an outlet hole 28. Referring to FIG. 6*a*, an ingredient container 26 is shown sitting on the ingredient container support tray 25. It should be understood that the ensuing operational description applies to both ingredient container 26 and ingredient container 27.

As shown in FIGS. 6*a* and 6*b*, valve mechanism 100 has a left hinge 41 which flexibly connects lever arm 43 to the valve base 40. Also attached to lever arm 43 is a generally cylindrical permanent magnet 42 and a generally cylindrical compressible valve seat 44 sufficiently large enough to cover and seal outlet hole 28. Magnet 42 is preferably in axial alignment with plunger 30*d* as shown in FIG. 6*a*. Magnet 42 is received in hollow cylindrical recess 42*a* in base 40 which is preferably in axial alignment with plunger 30*d* of solenoid 30. Solenoids 30 are affixed to the underside of the ingredient container support tray 25. Holes 29 in the ingredient container support tray 25 are positioned directly beneath the outlet hole 28 of each ingredient container 26, 27 as shown in FIGS. 6*a* and 6*b*.

Referring to FIG. 6*b*, when electrical current flows through the leads 30*a* and 30*b* to energize coil 30*c* of solenoid 30, an electromagnetic field is created around plunger 30*d*. Plunger 30*d* and solenoid 30 are located directly beneath permanent magnet 42, and the electromagnetic field created by energizing solenoid 30 repels the permanent magnet 42, lifting the lever arm 43 and compressible valve seat 44 from the position shown in FIG. 6*a* to the position shown in FIG. 6*b*. When the compressible valve seat 44 is lifted off of the outlet hole 28, liquid ingredients contained in containers 26 and 27 flow out of hole 28 under the influence of the liquid head caused by the level of liquid in the ingredient containers 26, 27.

When current stops flowing through solenoid 30, the electromagnetic field collapses and the permanent magnet 42, the lever arm 43 and the compressible valve seat 44 return from the position shown in FIG. 6*b* to their previous positions shown in FIG. 6*a*. The compressible valve seat 44 again covers outlet hole 28 and liquid flow stops. In this position, the permanent magnet 42 is attracted to plunger 30*d* of the solenoid 30 and helps to form a tight seal between the compressible valve seat 44 and the outlet hole 28.

Figure 7:
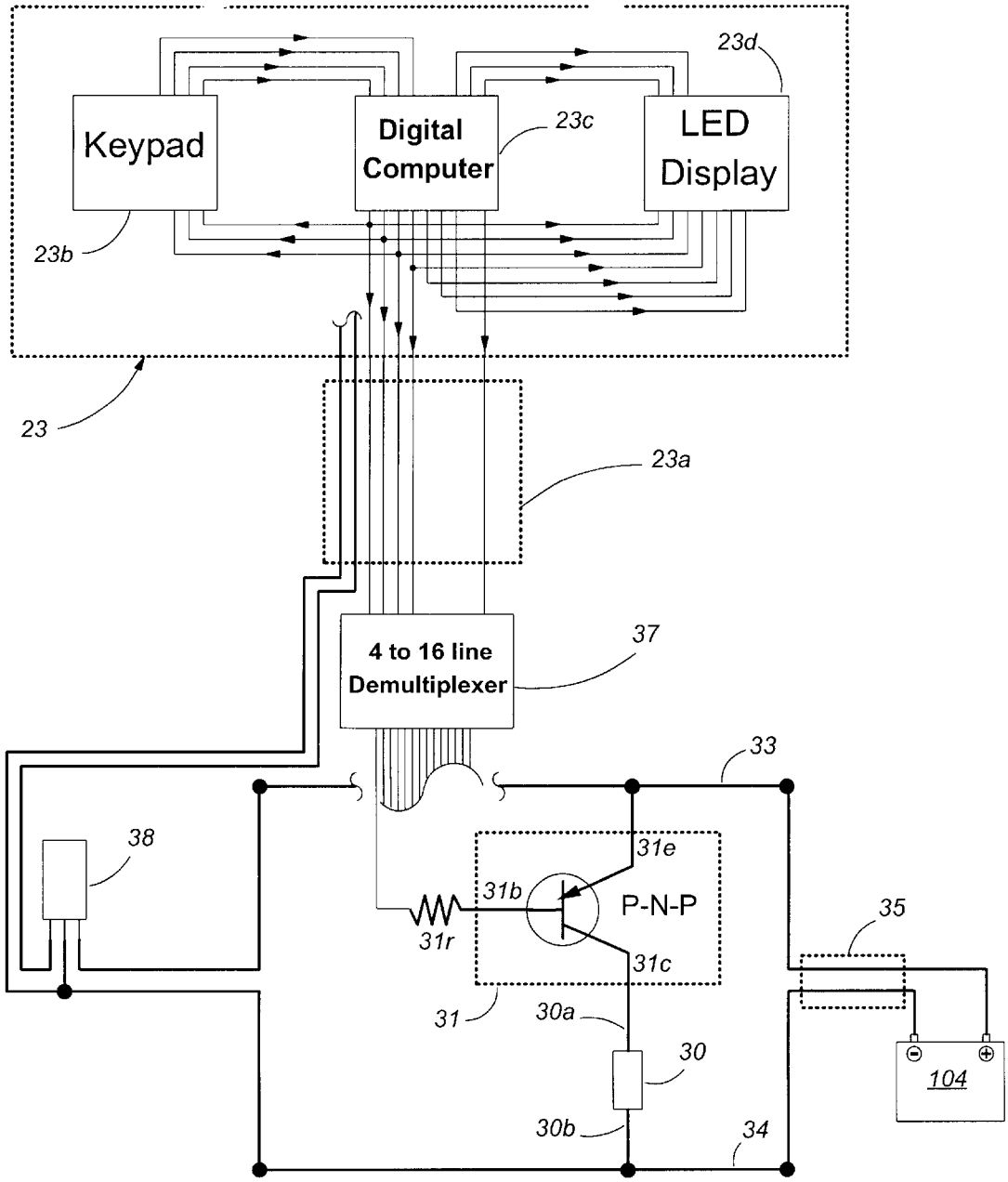
FIG. 7 is an electrical schematic view of the control system.

Referring to FIG. 7, a schematic of the control system is shown. User input is entered with the keypad 23*b* on user interface device 23 and read by a conventional programmable digital computer 23*c* well known in the art. Preferably computer 23*c* is a single chip programmable computer.

Computer 23*c* contains a program which (a) stores mixed drink recipes, the recipes indicating which of the ingredient containers 26, 27 are to be addressed and what amount of liquid ingredients stored therein are to be dispensed therefrom, (b) stores and updates the liquid ingredient level of the ingredient containers 26, 27, (c) calculates the time required to dispense ingredients under the influence of gravity according to the recipes, and (d) directs the valve mechanisms 100 associated with the ingredient containers 26, 27 to open according to the programmed recipes and alerts the user via light emitting diode display 23*d* when the level of any the liquid ingredients in containers 26,27 called for by the programmed recipes fall below a pre-programmed level.

Computer 23*c* outputs information to the user via a light emitting diode display 23*d* shown in FIGS. 1, 2, and 7. Keypad 23*b*, computer 23*c*, and light emitting diode 23*d* comprise the user interface device 23.

Once the user has selected a valid mixed drink choice from the menu shown in FIG. 8 and depressed a key corresponding to the selected drink on keypad 23*b*, computer 23*c* executes the programmed recipe by outputting signals via the control cable 23*a* to the inputs of a 4-to-16 line demultiplexer 37 shown in FIGS. 5 and 7. Demultiplexer 37 is a conventional demultiplexer well known in the art. Each of the outputs of the demultiplexer 37 is connected to a single biasing resistor 31*r* which is connected to base lead 31*b* of a single P-N-P power transistor of the plurality of transistors generally indicated by 31 (one for each of the ingredient containers 26 and 27). P-N-P transistors 31 are conventional transistors which are well known in the art. The emitter lead 31*e* of each transistor 31 is connected to the positive voltage bus 33 shown in FIG. 5 and 7. The collector lead 31*c* of each transistor 31 is connected to lead 30*a* of coil 30*c* of solenoid 30. The other lead 30*b* of coil 30*c* of solenoid 30 is connected to the ground bus 34. When a particular transistor 31 is addressed by the demultiplexer 37, current flows through the transistor 31 and its associated solenoid 30 producing an electromagnetic field which repels permanent magnet 42 mounted inside a plurality of ingredient containers 26 and 27 as shown in FIG. 6*b* to enable ingredients to flow from a selected container 26, 27 through outlet hole 28 and 29 as indicated by arrow 102.

As shown in FIGS. 5 and 7, in the present embodiment, the apparatus 10 preferably utilizes eighteen volt direct current electrical power from battery 104 which enters the demultiplexer board 36 via the power cable 35. Other conventional power sources could be substituted for battery 104. The power cable 35 is connected to a five volt direct current voltage regulator 38 which powers the demultiplexer 37. The five volt direct current voltage regulator 38 also provides power to the user interface device 23 via the control cable 23*a*. The power cable 35 also provides power to the positive voltage bus 33 to run the solenoids 30.

Referring to FIG. 8, a sample menu of typically available mixed drinks is shown. Each mixed drink is identified by a unique number on the menu. This number corresponds to a recipe that resides in the programmable memory of a digital computer.

Therefore, when computer 23*c* shown in FIG. 7 in user interface device 23 actuates a solenoid 30 as previously described, liquid flows from the ingredient containers 26 and/or 27 out of outlet hole 28, through the ingredient container support tray 25 via hole 29 and through the chest 21 via hole 39 onto the catch pan 24 and through the outlet pipe 24*a* to the user's cup 46.

In summary, the mixed drink dispensing apparatus 10 of the present invention employs computer 23*c* which calculates the time required to dispense a desired amount of liquid from a container 26, 27 based on the level of the liquid in the container according to the gravity flow rate relationship described previously in the Background of the Invention. Because computer 23*c* has the ability to compensate for the non-linear nature of gravity flow, the present invention requires only a simple valve mechanism 100 to control flow out of containers 26, 27. Valve mechanism 100 is installed in each of the storage containers 26, 27 to dispense the liquid ingredients of the drinks.

Because the dispensation times (the time that each of the valve mechanisms 100 are opened) are computed based on the level of liquid in a given container 26, 27, computer 23*c* stores the liquid level of the ingredients in each container 26, 27 in its memory. The starting level of liquid in each container 26, 27 defaults to a level commensurate with the fill volume of the container 26, 27 unless otherwise directed by the user. With each dispensation of liquid from a container 26, 27, the program of computer 23*c* updates (decrements) the level of the liquid in the container by the amount called for by the mixed drink recipe. The current level of liquid ingredients of each container 26, 27 is stored in the memory of computer 23*c*, and computer 23*c* can inform the user if a requested mixed drink recipe calls for an ingredient from a container with an insufficient liquid level. In U.S. Pat. Nos. 3,940,019 and 3,991,911, this function was carried out by means of level and/or pressure switches. Finally, in automatic mixed drink dispensing apparatus 10, the total amounts of liquid dispensed from individual containers 26, 27 can be computed if desired.

In the present invention, the mixed drink recipes (which existed as networks of discrete electronic components in U.S. Pat. Nos. 3,940,019 and 3,991,911) are stored in the programmable memory of computer 23*c*. Being stored as software, the mixed drink recipes are easily changed and occupy minuscule physical space as compared to their discrete component counterparts in prior art.

Another unique feature of automatic mixed drink dispensing apparatus 10 is that the dispenser actuation apparatus (solenoid 30) is physically isolated from the liquid dispensation apparatus (valve 100). As described above, solenoids 30 under the control of computer 23*c* are utilized to actuate valves 100 in liquid containers 26, 27. In normal operation, an electromagnetic field produced in the coil of a solenoid causes the plunger of the solenoid to move and do mechanical work. In the present invention, the plunger 30*d* is held stationary within the coil 30*c* of the solenoids 30 to intensify the electromagnetic field created by energizing the solenoids 30. Through electromagnetic repulsion created by energizing the solenoids 30, permanent magnet 42 within containers 26, 27 above the energized solenoid 30 is made to move without physical contact. Therefore, there are no pneumatic or hydraulic tubes or electrical wires to disconnect to remove and clean the containers 26, 27.

In U.S. Pat. Nos. 3,940,019 and 3,991,911, once liquid was dispensed from a container, it was typically transported to a handheld dispensing head via a plurality of tubes. These tubes were designed to keep the individual ingredients from prematurely mixing or preventing cross contamination from any residual liquid. Cleaning of the dispensing head and the tubes required flushing, or if a thorough job was required, disassembly of the plurality of tubes due to limited access to their interior surfaces. In the present invention, all ingredients free fall from their containers 26, 27 onto catch pan 24. The surfaces 24*f* and 24*g* of catch pan 24 are inclined such that minimal liquid remains on the surfaces 24*f* and 24*g* after valve mechanism 100 closes. The inclined surfaces 24*f* and 24*g* direct the liquids to a single outlet pipe 24*a* and to the user's cup 46. As described above, ready access is afforded to the catch pan for ease of cleaning.

In U.S. Pat. Nos. 3,940,019 and 3,991,911, the control panel included an array of labeled pushbuttons, one for each mixed drink available. The number of mixed drinks available was essentially fixed once the control panel was fabricated. In the present invention, a printed menu shown in FIG. 8 of available mixed drinks is displayed proximate to the user interface 23. Each drink is identified by a unique number shown in the left column of FIG. 8 corresponding to its recipe in the computer 23*c*. Changing the mixed drinks available is accomplished by altering the program and reprinting the menu. Available drinks are limited only by the choice of ingredients and the tastes of the user. Drink selection is made with a one or two digit entry on keypad 23*b* on the user interface. Keypad 23*b* preferably has 12 keys.

Although the preferred embodiments of the invention have been described in detail above, it should be understood that the invention is in no sense limited thereby, and its scope is to be determined by that of the following claims:

What is claimed is:

1. An automatic mixed drink dispensing apparatus comprising:

a. a plurality of containers for holding and dispensing liquid ingredients, each of said containers having
   i. a top end and a bottom end,
   ii. an outlet in said bottom end of said container for dispensing liquid ingredients from said container,
   iii. a control device for selectively controlling the flow of liquid dispensed from said container through said outlet, said control device including a valve for selectively closing said outlet to stop liquids from flowing therethrough and a solenoid for selectively opening and closing said valve, said valve having a permanent magnet connected thereto, and said solenoid having a plunger and a coil, said plunger being located inside of said coil, said plunger being rigidly connected to said coil to prevent said plunger from moving in said coil, said solenoid being adapted to repel said permanent magnet when electrical energy is supplied to said solenoid and said permanent magnet being attracted to said plunger when electrical energy is not supplied to said solenoid, b. a chest for housing said containers, said chest having at least one outlet therein for discharging liquids dispensed from said containers, c. a user interface device for selectively actuating each of said control devices to dispense ingredients from said containers to make said mixed drink.

2. The automatic mixed drink dispensing apparatus of claim 1 wherein said valve is connected to the inside of said bottom end of said container by a hinge.

3. The automatic mixed drink dispensing apparatus of claim 2 wherein said solenoid is connected adjacent to the outside of said bottom end of said container.

4. The automatic mixed drink dispensing apparatus of claim 1 wherein said solenoid is connected adjacent to the outside of said bottom end of said container.

5. The automatic mixed drink dispensing apparatus of claim 1 wherein said containers are located in a tray for supporting and aligning said containers in said chest.

6. The automatic mixed drink dispensing apparatus of claim 5 wherein said solenoids are connected to said tray.

7. The automatic mixed drink dispensing apparatus of claim 1 wherein said user interface device comprises:

a. a keypad for inputting user selection of a choice of said mixed drink;

b. a computer for accepting said inputting from said keypad and for actuating said control devices to dispense said ingredients from said containers to make said mixed drink.

8. The apparatus of claim 7 wherein said computer is a digital computer having a programmable memory containing a program for:

a. storing mixed drink recipes, said recipes indicating which of said containers are to be addressed and what amount of liquid ingredients stored in said containers are to be dispensed therefrom, b. storing and updating the level of said liquid ingredients in said containers, c. using said level to calculate the time required to dispense said liquid ingredients under the influence of gravity according to said recipes, and d. directing said control devices associated with said containers to open said valves according to said programmed recipes and alert the user when the level of any of said liquid ingredients in said containers called for by said programmed recipes fall below a preprogrammed level.

9. The automatic mixed drink dispensing apparatus of claim 1 wherein said chest is located in a support stand.

10. The automatic mixed drink dispensing apparatus of claim 9 wherein a catch pan is located inside said support stand beneath said chest for receiving said ingredients dispensed from said containers and conveying said ingredients to an outlet in said catch pan for conveying said ingredients into a user's mixed drink container.

11. An automatic mixed drink dispensing apparatus comprising:

a. a plurality of containers for holding and dispensing liquid ingredients, each of said containers having i. a top end and a bottom end, ii. an outlet in said bottom end of said container for dispensing liquid ingredients from said container, iii. a control device for selectively controlling the flow of liquid dispensed from said container through said outlet, said control device including a valve for selectively closing said outlet to stop liquids from flowing therethrough and a solenoid for selectively opening and closing said valve, said valve having a permanent magnet connected thereto, and said solenoid having a stationary plunger which does not move inside said, said solenoid being adapted to repel said permanent magnet when electrical energy is supplied to said solenoid and said permanent magnet being attracted to said plunger when electrical energy is not supplied to said solenoid, b. a chest for housing said containers, said chest having at least one outlet therein for discharging liquids dispensed from said containers, c. a user interface device for selectively actuating each of said control devices to dispense ingredients from said containers to make said mixed drink.

12. The automatic mixed drink dispensing apparatus of claim 11 wherein said valve is connected to the inside of said bottom end of said container by a hinge.

13. The automatic mixed drink dispensing apparatus of claim 12 wherein said solenoid is connected adjacent to the outside of said bottom end of said container.

14. The automatic mixed drink dispensing apparatus of claim 11 wherein said solenoid is connected adjacent to the outside of said bottom end of said container.

15. The automatic mixed drink dispensing apparatus of claim 11 wherein said containers are located in a tray for supporting and aligning said containers in said chest.

16. The automatic mixed drink dispensing apparatus of claim 15 wherein said solenoids are connected to said tray.

17. The automatic mixed drink dispensing apparatus of claim 11 wherein said user interface device comprises:

a. a keypad for inputting user selection of a choice of said mixed drink;

b. a computer for accepting said inputting from said keypad and for actuating said control devices to dispense said ingredients from said containers to make said mixed drink.

18. The apparatus of claim 17 wherein said computer is a digital computer having a programmable memory containing a program for:

a. storing mixed drink recipes, said recipes indicating which of said containers are to be addressed and what amount of liquid ingredients stored in said containers are to be dispensed therefrom, b. storing and updating the level of said liquid ingredients in said containers, c. using said level to calculate the time required to dispense said liquid ingredients under the influence of gravity according to said recipes, and d. directing said control devices associated with said containers to open said valves according to said programmed recipes and alert the user when the level of any of said liquid ingredients in said containers called for by said programmed recipes fall below a preprogrammed level.

19. The automatic mixed drink dispensing apparatus of claim 11 wherein said chest is located in a support stand.

20. The automatic mixed drink dispensing apparatus of claim 19 wherein a catch pan is located inside said support stand beneath said chest for receiving said ingredients dispensed from said containers and conveying said ingredients to an outlet in said catch pan for conveying said ingredients into a user's mixed drink container.

* * * * *